US006802736B2

(12) United States Patent
Godefroy et al.

(10) Patent No.: US 6,802,736 B2
(45) Date of Patent: Oct. 12, 2004

(54) DEVICE FOR RETAINING A CONTACT IN AN ELECTRICAL CONTACT-CARRYING MODULE

(75) Inventors: Alban Godefroy, Epernon (FR); Claude Casses, Clevilliers (FR)

(73) Assignee: FCI, Paris (FR)

( * ) Notice: Subject to any disclaimer, the term of this patent is extended or adjusted under 35 U.S.C. 154(b) by 146 days.

(21) Appl. No.: 10/148,542

(22) PCT Filed: Oct. 1, 2001

(86) PCT No.: PCT/EP01/11341

§ 371 (c)(1),
(2), (4) Date: May 31, 2002

(87) PCT Pub. No.: WO02/29935

PCT Pub. Date: Apr. 11, 2002

(65) Prior Publication Data

US 2003/0129882 A1 Jul. 10, 2003

(30) Foreign Application Priority Data

Oct. 2, 2000 (FR) ..... 00 12537

(51) Int. Cl.[7] ..... H01R 9/07
(52) U.S. Cl. ..... 439/492; 439/752
(58) Field of Search ..... 439/752, 352, 439/459, 492, 733.1, 493, 596, 449

(56) References Cited

U.S. PATENT DOCUMENTS

| | | | | |
|---|---|---|---|---|
| 3,982,805 A | | 9/1976 | Irie | 339/59 R |
| 4,711,508 A | | 12/1987 | Sueyoshi | 439/595 |
| 4,938,713 A | * | 7/1990 | Daly et al. | 439/492 |
| 5,601,454 A | | 2/1997 | Suzuki et al. | 439/595 |
| 5,664,326 A | | 9/1997 | Ohsumi | 29/874 |
| 5,743,770 A | | 4/1998 | Hamai | 439/752.5 |
| 6,120,333 A | * | 9/2000 | Ko | 439/748 |

* cited by examiner

*Primary Examiner*—Alex Gilman
(74) *Attorney, Agent, or Firm*—Perman & Green, LLP

(57) ABSTRACT

The object of the invention concerns a device for retaining a contact (16) in a housing (14) of an electrical connection module (10), the said contact comprising in its rear part a blade (20) comprising retaining means (50).

Figure 1A:
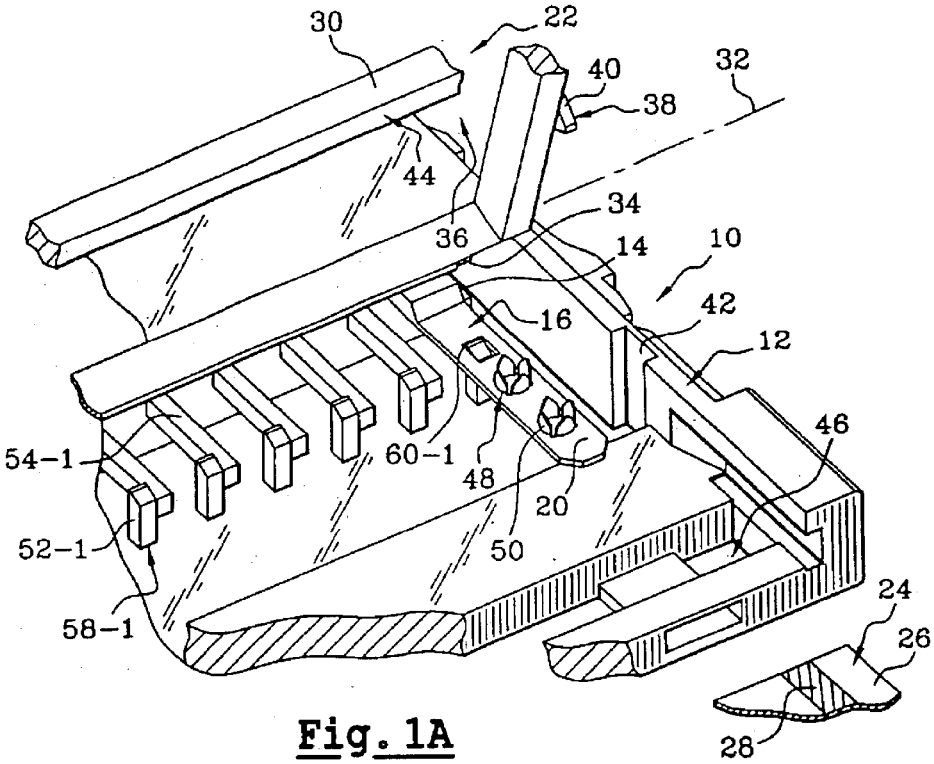

Application to modules receiving flexible circuits.

13 Claims, 5 Drawing Sheets

DEVICE FOR RETAINING A CONTACT IN AN ELECTRICAL CONTACT-CARRYING MODULE

This application claims the benefit of the earlier filed International Application No. PCT/EP01/11341, International Filing Date, Oct. 1, 2001, which designated the United States of America, and which international application was published under PCT Article 21 (2) in English as WO Publication No. WO 02/29935 A1.

The present invention concerns a device for retaining a contact in an electrical contact-carrying module.

In the field of electrical connectors, there are used connectors which comprise modules adapted to receive contacts, and more particularly contacts which are to be integrated and connected electrically to flexible circuits also called "flex".

Such flexible circuits comprise one or several insulating layers on which are built up wiring lines that must be connected to these contacts, which, in turn, assure electrical connection with another module or with the contacts of a product to be connected.

To that end, it is known to provide a male contact with a forward portion comprising a pin, or a female contact with a forward portion of a cage type, but, in either case, each contact is extended rearwardly by a blade. This blade is provided with cutouts defining pins to be seated on the flexible circuit.

These pins have a penetrating capability which is used to advantage for piercing the wiring line and the insulating material. Then, the pins are seated, so as on the one hand to prevent withdrawal of the sheet, and, on the other hand, to ensure a sufficient electrical contact.

Consequently, these assemblies also assure the mechanical retention of the flexible circuit with respect to each of the contacts.

Thus, when the flexible circuit is pulled, especially by an intentional force in the case of a rough disassembly or unintentionally for whatever reason, although the sheet is restrained in the module by other mechanical means, the contacts also are subjected to a pulling force.

Therefore, each contact is immobilized with respect to the module, such that this contact remains in the housing of the module which receives it, even when the flexible circuit is subjected to pulling.

Moreover, during the connection, the introduction of the electrical contacts of one module into the electrical contacts of the other, requires an insertion force which tends to push the contacts into their housings, which makes it essential to prevent defects giving rise to a non-connection, leading to a failure of the electrical connection. Worse, this could give rise to a short circuit that goes undetected by initial quality control, but which, in service, proves to be defective.

It is therefore very important to prevent any recoil of each contact in its respective housing within the module.

The object of the invention is to propose a device for retaining each contact of an electrical connector module, which is simple, which does not impede mounting the said contact in the module, which is reliable, which is applied to each contact individually, which does not increase the exterior bulk, and which is formed by molding when the device is made in this way.

To that end, the device for retaining a contact in a housing of an electrical connection module, the said contact comprising in its rear portion a blade, is characterized in that it comprises retaining means composed of at least one rear abutment, integral with the body of the module and arranged so as to cooperate with a retaining element of said contact, this contact comprising an unsupported section between the forward portion and the rear extremity of the blade, opposite which are received the said retaining means.

According to a group of alternative embodiments, the rear abutment is disposed at the end of a flexible catch.

According to the various characteristics, the abutment cooperates with a window provided in the blade, with a tab cut out from the blade, and comprises a double locking.

According to another variation, the abutment may be integral with a flap that is moveable relative to the body of the module and cooperates with a tab carried by the blade.

Figure 1B:
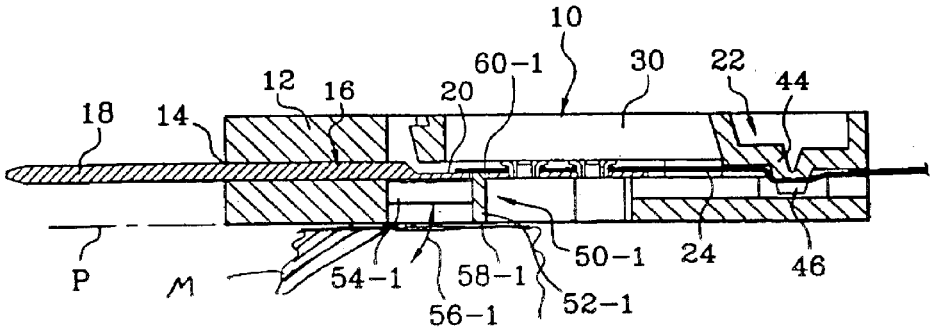
Figure 2A:
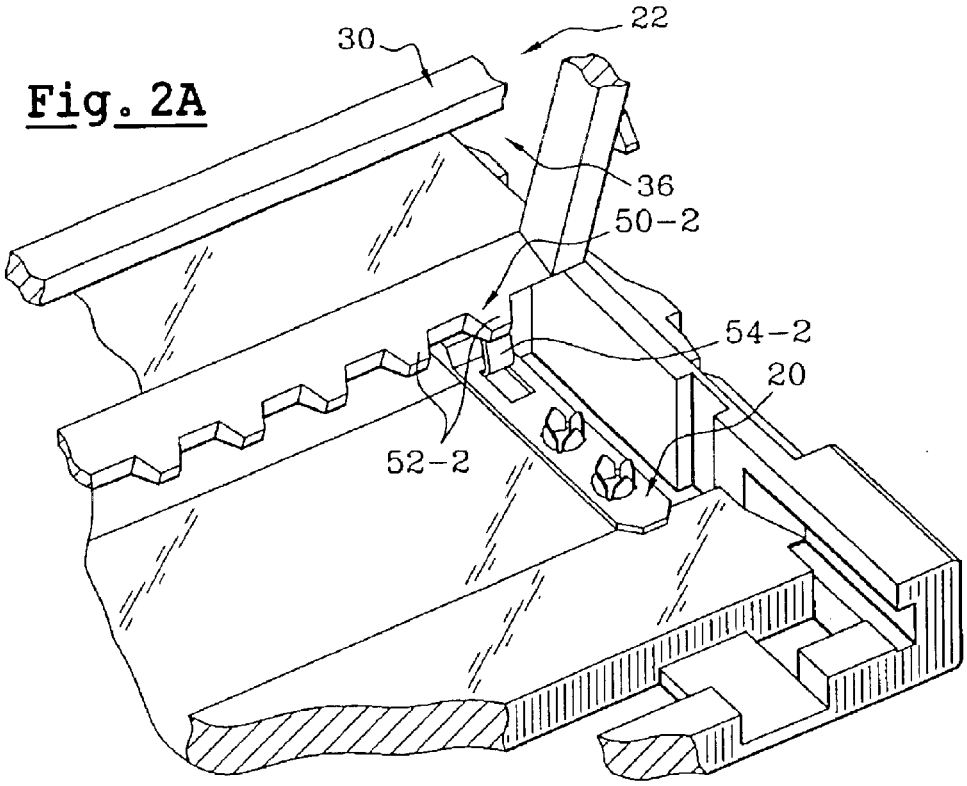
Figure 2B:
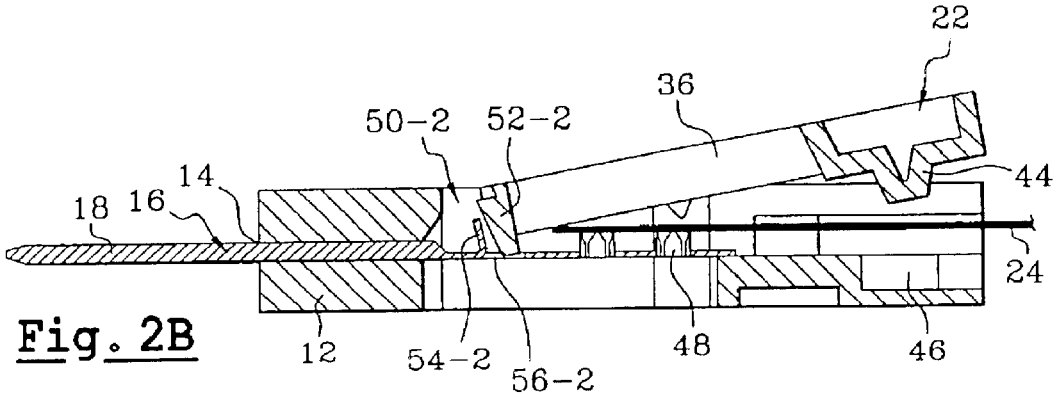
Figure 2C:
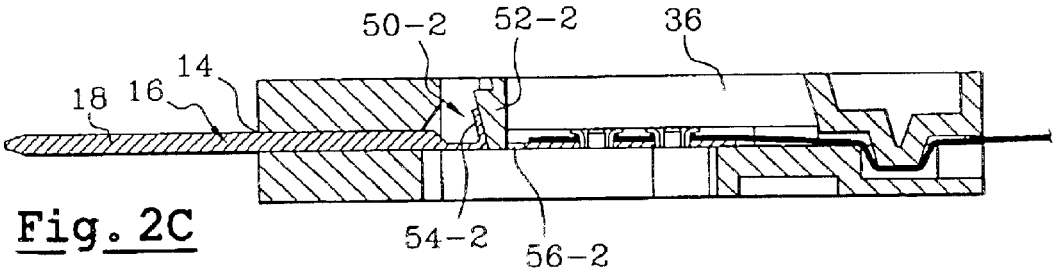
Figure 3A:
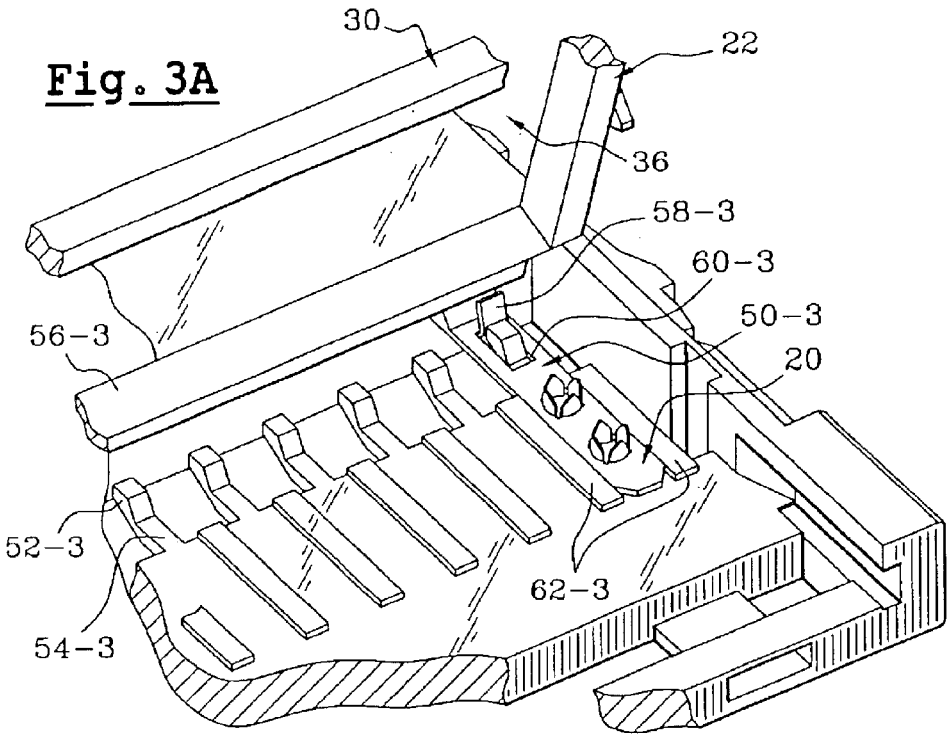
Figure 3B:
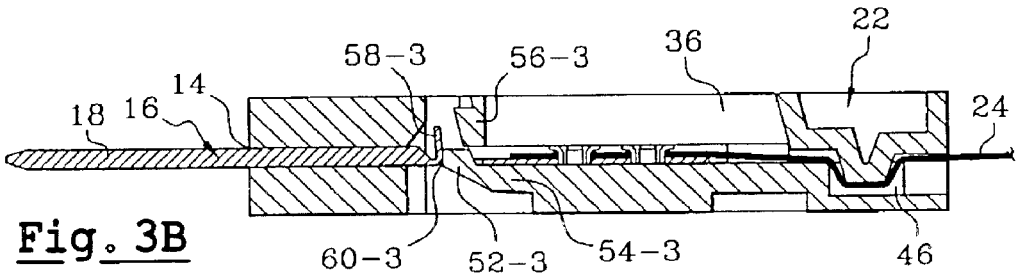
Figure 3C:
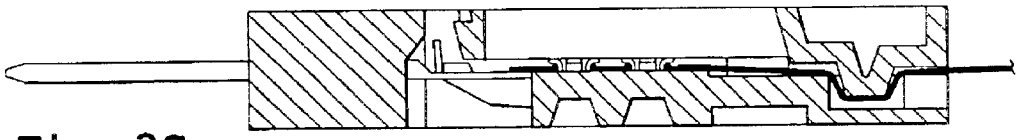
Figure 4A:
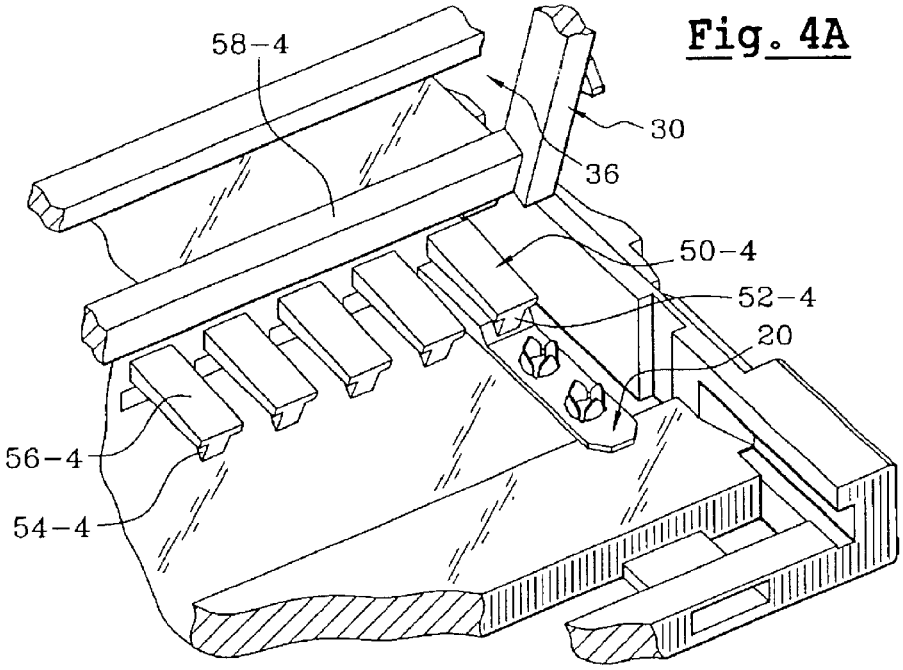
Figure 4B:
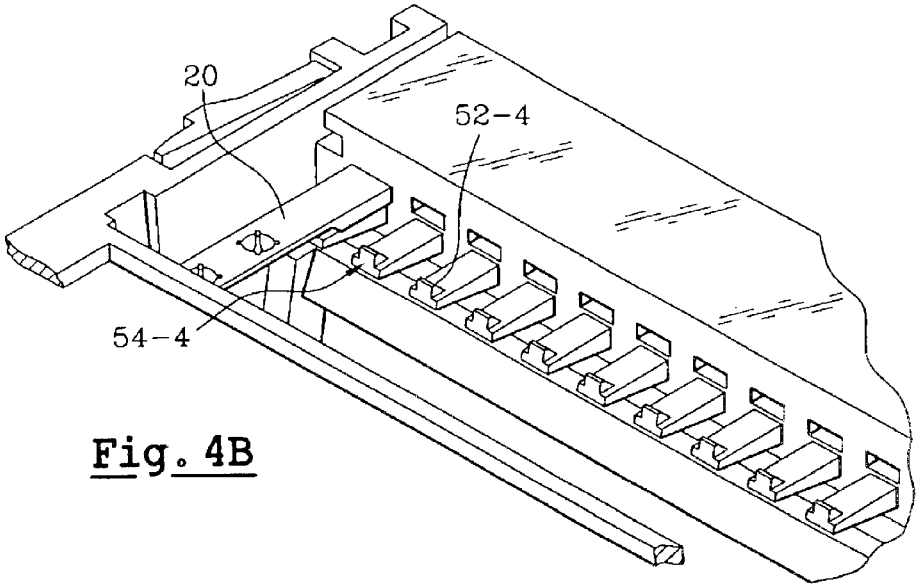
Figure 4C:
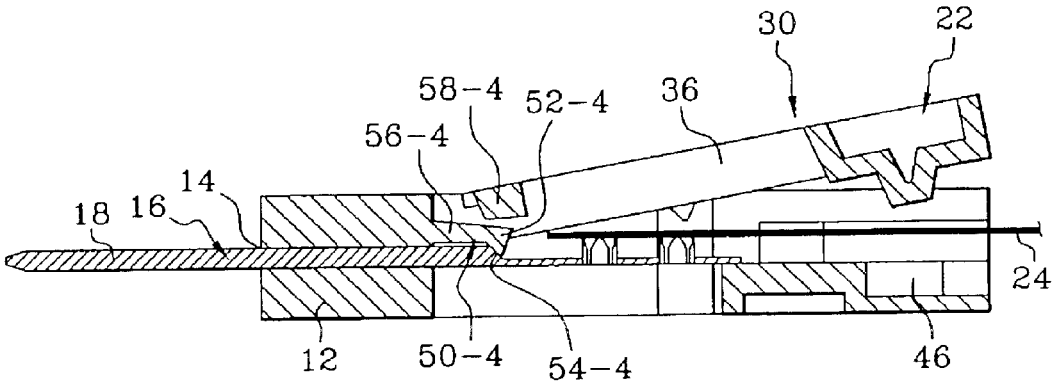
Figure 4D:
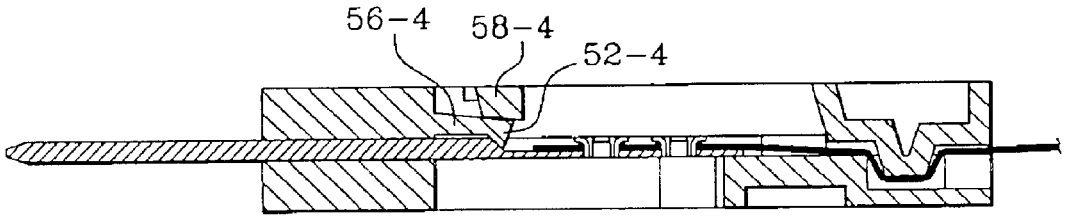

The present invention is described hereinafter with reference to the accompanying drawings, which represent a preferred embodiment and variations thereof, and wherein:

FIG. 1A is a partial perspective view that shows in detail a first embodiment, FIG. 1B is a sectional view of the device of FIG. 1A, FIG. 2A is a partial perspective view that shows in detail a second embodiment, FIGS. 2B and 2C are sectional views of the device of FIG. 2A, before and after seating of the pins, FIG. 3A is a partial perspective view that shows a third embodiment, FIGS. 3B and 3C are two sectional views, median and inter-contact, of the device of FIG. 3A, FIG. 4A is a partial perspective view from above that shows a fourth embodiment, FIG. 4B is a view identical to that of FIG. 4A but from below, and FIGS. 4C and 4D are sectional views before and after seating of the pins.

In FIG. 1A, in the case of this first embodiment of the device for retaining contacts, reference is made first to a module adapted to be equipped with this device. The same module may be used for each of the variations with the same reference numerals, only the reference numerals pertaining to modified portions being thereafter indicated.

The module 10 comprises a body 12, housings 14 adapted to receive electrical contacts 16, in this case male contacts each having a forward pin 18 and a blade 20.

Each rear blade is accessible.

This module assembly comprises means 22 for retaining the flexible circuit 24 to be inserted. This flexible circuit comprises in a known manner an insulating layer 26 and conductive wiring lines 28, having dimensions adapted to the contacts 16.

These retaining means comprise, in a manner specified in detail in a related application in the name of the same applicant, a flap 30 mounted for rotation about an axis 32. This flap is advantageously formed by molding with the body, the connection being effected via two flexible strips 34.

This flap comprises a window 36 that opens above the blades 20. This window is adapted so as to allow the passage of a seating tool, not shown. Such a tool is well known and has the form of a striker provided with specially shaped grooves for provoking the seating.

Laterally, this flap is equipped with snap lock means 38 composed of a pair of tabs 40, adapted to cooperate with a pair of opposed grooves 42 provided in the body 12.

These retaining means comprise a projecting tongue 44 carried by the flap, formed by molding and having a substantially trapezoidal cross section.

In facing relation, the body 12 is provided with a groove 46 of complementary profile, adapted to receive this tongue. As is best seen in FIG. 1B, after lowering the flap, the flexible circuit undergoes an offset deformation which permits an acceptable mechanical retention.

Each contact comprises a blade 20 in the rear portion which projects from the housing 14 in which it is received. This blade carries pins 48 having a pointed shape so as to have a penetrating capability. This blade is supported.

As is shown in FIG. 1B, during mounting of the flexible circuit in the module, the pins perforate the sheet and are flattened by a crimping operation. The flap itself is thus in lowered position.

This module also comprises a retaining device, which is constituted of mechanical retaining means 50-1.

In this first embodiment, each means comprises a rear abutment 52-1, provided with an inlet ramp permitting insertion of the contact in the forward/reverse direction. This abutment is carried by a support catch 54-1, which is flexible in the two directions indicated by the double arrow 56-1. This permits the abutment to move itself out of the way of the contact during its insertion, and return to its initial retaining position.

This abutment has an inclined surface in the shape of a ramp in the insertion direction, and a perpendicular surface in the opposite direction. In its lower portion, this abutment comprises a claw 58-1. As indicated in FIG. 1A, the claw extends to the lower plane P of the module body.

A window 60-1 is provided in the blade 20 of the contact 16. The end of the abutment may pass through this window in the stable retaining position, since this abutment 52-1 has its end above the plane of the blade 20.

Thus, during insertion of the contact, this latter comes to bear on the ramp, which causes the bending of the catch and the lowering of the abutment.

When the contact becomes forwardly set in its housing 14, positioned by any means, the abutment 52-1 passes through the window under the elastic return force of the catch 54-1.

The contact is thus fixed in its housing.

It will also be noted that in the case where the module is introduced in a module-carrier, not shown, the catch is locked in this retaining position since the claw 58-1 in the plane P comes into contact against the walls of the housing of the contact-carrier in which it is received.

These retaining means permit maintaining the contact in its housing in an especially reliable manner, with a supplementary locking in case of mounting in a module-carrier.

In FIGS. 2A, B and C, the module is for the most part identical and only the retaining means 50-2 are modified.

Specifically, these retaining means of the second embodiment comprise a rear abutment 52-2, integral with the flap 30.

The blade 20 carries a tab 54-2, lifted upwardly, and formed so as to define a window 56-2. Thus, when the flap is lowered, the rear abutment 52-2 comes to bear on the tab 54-2 and passes into the thickness of this blade, through this window 56-2, as shown in FIGS. 2B and 2C.

The blade of the contact 16 is thus fixed and the overall contact is maintained locked in its housing 14.

According to a third embodiment, retaining is effected with a catch that is once again moveable, but comprises especially a double lock.

The retaining means 50-3 comprise a rear abutment 52-3 with a ramp in the forward/reverse direction of contact insertion, this abutment being carried by a catch 54-3 oriented from the rear toward the front. This catch is flexible and permits the abutment to be moved out of the way during the force exerted by the contact during its insertion and to resume its initial stable retaining position.

The inner edge of the window 36 is provided with a rim 56-3 which extends across all the width of the module and whose height is such that it becomes juxtaposed with the abutment when the flap is lowered and the catch is in the stable retaining position.

The blade 20 of the contact 16 is also provided with a tab 58-3, lifted upwardly, made with the contact and which defines a window 60-3.

After the flap is lowered, the rim 56-3 forms a first retaining support and the abutment 52-3 ensures a fixing of this contact. There are thus two complementary securements.

Such an arrangement is advantageous, as it permits disposing a double locking even if the module is not mounted in a module-carrier.

Moreover, as can be seen from these same figures, it is provided with lateral guides 62-3 which permit any displacement of the blades laterally, especially before seating as in FIG. 3A. Thus, the blades of the contacts are disposed well below the pins at the moment of seating, prior to the flap being totally lowered, and the rim provides a complementary locking.

It will also be observed that the catch in this arrangement does not have any sharp edge.

The fourth embodiment has the advantage of using the contact with its blade, without a window, while providing a double locking.

Specifically, the retaining means 50-4 comprise a rear abutment 52-4 which has the form of a reversely inclined ramp 54-4, having a profile coordinated with that of the slope of the blade 20. In the same place of the junction zone between the body and the blade, the contact necessarily has a junction slope.

This abutment is carried by a flexible catch 56-4, which permits this abutment to come undone during the introduction of the contact into its housing 14.

The interior rim 58-4 of the flap 30 extends over the entire width of the module, and the height is such that it lays upon the abutment 52-4 and the catch 56-4 when the flap is completely lowered, as shown in FIG. 4D. There is thus a double locking of the contact.

It will be noted that the reversely inclined ramp 54-4 is supported integrally on the slope of the contact junction.

In any embodiment, each contact comprises a forward zone inserted at least partially into the housing and a blade supported on the body of the module at its end, so that there results an unsupported intermediate section, which permits disposing the retaining means.

What is claimed is:

1. Device for retaining a contact in a housing of an electrical connection module the contact comprising in a rear portion thereof a conductor termination blade with an unsupported section, unsupported by the housing, between a front part and a rear end of the blade and extending across the blade from one blade edge to an opposite blade edge, characterized in that the device comprises retaining means composed of at least one rear abutment, integrated with the body of the module and arranged to cooperate with a retaining element disposed in the unsupported section of the contact.

2. Device for retaining according to claim 1, characterized in that the rear abutment is disposed on a flap which is integral with and moveable relative to the body of the module and the retaining means further comprise a tab carried by the blade, lifted upwardly, to define a window, the said rear abutment coming into contact with the tab and passing through this window.

3. Device for retaining a contact according to claim 1, characterized in that the abutment is disposed at the end of a flexible catch.

4. Device for retaining according to claim 3, characterized in that the abutment comprises a claw assuring a double locking when the module is inserted in a module carrier.

5. Device for retaining according to claim 3, characterized in that the catch extends along the body of the module from the front toward the rear.

6. Device according to claim 3, characterized in that the blade comprises a tab ensuring a double locking with a rim of a flap that is moveable with respect to the body of the module, when this flap is lowered.

7. Device for retaining a contact according to claim 3, characterized in that the abutment cooperates with a window arranged in the blade.

8. Device for retaining a contact according to claim 7, characterized in that the abutment comprises a ramp for insertion of the contact in the forward/reverse direction.

9. Device for retaining according to claim 3, characterized in that the catch extends along the body of the module from the rear toward the front.

10. Device for retaining according to claim 9, characterized in that it comprises lateral guide for the blade of the contact.

11. Device for retaining according to claim 3, characterized in that the abutment comprises a reversely inclined ramp whose profile is coordinated with that of a slope facing the blade of the contact, opposite the junction zone between the body and the blade.

12. Device for retaining according to claim 11, characterized in that it comprises a double locking constituted of a rim of a moveable flap of the module, which is laid upon, in lowered position, the catch.

13. An electrical connector comprising:

a housing with at least one contact receiving cavity formed therein; and at least one contact located in the at least one contact receiving cavity, the contact having a rear portion formed by conductor termination blade, the conductor termination blade including an unsupported section between a front part and rear end of the blade and extending across the blade from one blade edge to an opposite blade edge;

wherein the housing has a contact retainer with an abutment arranged to engage the unsupported section of the contact.

* * * * *